US009891013B2

(12) United States Patent
Biselli et al.

(10) Patent No.: US 9,891,013 B2
(45) Date of Patent: Feb. 13, 2018

(54) MODULAR STORE

(71) Applicant: OTO MELARA S.P.A., La Spezia (IT)

(72) Inventors: Gianluca Biselli, La Spezia (IT); Andrea Chiappini, La Spezia (IT)

(73) Assignee: OTO MELARA S.P.A., La Spezia (IT)

( * ) Notice: Subject to any disclaimer, the term of this patent is extended or adjusted under 35 U.S.C. 154(b) by 4 days.

(21) Appl. No.: 14/653,657

(22) PCT Filed: Dec. 18, 2013

(86) PCT No.: PCT/IB2013/061064

§ 371 (c)(1),
(2) Date: Jun. 18, 2015

(87) PCT Pub. No.: WO2014/097159

PCT Pub. Date: Jun. 26, 2014

(65) Prior Publication Data

US 2015/0308765 A1 Oct. 29, 2015

(30) Foreign Application Priority Data

Dec. 19, 2012 (IT) ..... TO2012A1103

(51) Int. Cl.
*B65G 1/00* (2006.01)
*F41A 9/21* (2006.01)
*F41A 9/78* (2006.01)

(52) U.S. Cl.
CPC . *F41A 9/21* (2013.01); *F41A 9/78* (2013.01)

(58) Field of Classification Search
CPC ..... B65G 1/0407
USPC ..... 414/277, 267, 280, 282
See application file for complete search history.

(56) References Cited

U.S. PATENT DOCUMENTS 4,430,837 A * 2/1984 Kirschenbaum ..... 285/330
2011/0031091 A1* 2/2011 Fatula, Jr. et al. ..... 198/463.3

FOREIGN PATENT DOCUMENTS

EP 0881454 A1 12/1998
GB 2146414 A 4/1985
WO WO 98/27397 A1 6/1998

OTHER PUBLICATIONS

International Search Report for corresponding International Patent Application No. PCT/IB2013/061064, dated Apr. 8, 2014.

* cited by examiner

*Primary Examiner* — Saul Rodriguez
*Assistant Examiner* — Willie Berry, Jr.
(74) *Attorney, Agent, or Firm* — Merchant & Gould P.C.

(57) ABSTRACT

A store includes supplying modules, which define rows, which are arranged one next to the other. Each row has a predetermined number of crates. At least one flooring structure, which supports the supplying modules, defines a walk-off surface. A moving system for a handler of the crates includes an overhead-travelling-crane, which is arranged in the upper part of the supplying modules and is adapted to move the handler in a reference plane, so as to reach the single crates. The overhead-travelling-crane includes a horizontal truss, which, in turn, has a carriage, to which the handler is fixed. The horizontal truss is adapted to slide along at least two longitudinal guides rigidly fixed to the supplying modules of the external rows, which define the horizontal extension of the store. Each module is rigidly fixed to the flooring structure.

9 Claims, 9 Drawing Sheets

MODULAR STORE

This application is a National Stage Application of International Patent Application No. PCT/IB2013/061064, filed Dec. 18, 2013, which claims benefit of Serial No. TO2012A001103, filed Dec. 19, 2012 in Italy and which application(s) are incorporated herein by reference. To the extent appropriate, a claim of priority is made to each of the above disclosed applications.

BACKGROUND OF THE INVENTION

The present invention is relative to a modular store, adapted to adjust to the shape of the place where it is positioned.

This store is adapted to be positioned in a hold of a ship and is able to reduce the positioning errors caused by the deformations due to the structural deformations to which the hold of a ship is subject.

Stores are known, which comprise an overhead-travelling-crane to move a handler among a plurality of supplying modules, which are arranged in rows comprising a plurality of crates where objects are stowed.

Said modules are arranged so as to create one or more lanes where the handler can move, the handler being moved by means of said overhead-travelling-crane.

The support structure of the overhead-travelling-crane is independent of the structure of the supplying modules themselves.

The use of these stores on board ships is very complex, since the movements and the structural deformations, which are due to the movements of the ship itself, cause a deformation of the elements of the store.

Since the structures of the overhead-travelling-crane and of the supplying modules are independent and have different shapes and sizes, they are subject to different forces. These different forces cause different deformations among the different elements of the store.

The different structural deformations of the different elements comprised in the store cause and increase in the positioning error both of the handler relative to the single crane and of the overhead-travelling-crane relative to the different supplying modules.

These positioning errors can be hardly compensated by the moving system of the overhead-travelling-crane and/or of the handler.

Furthermore, the use of elements that are structurally separated from one another requires a larger space for the assembly of the store and to allow the handler to be moved in the different lanes.

SUMMARY OF THE INVENTION

The presents invention wants to solve the above-mentioned technical problems by providing a modular store, which is able to reduce the positioning errors and to optimize the space taken up.

BRIEF DESCRIPTION OF THE DRAWINGS

The features and advantages of the store according to the present invention will be best understood upon perusal of the following description of different non-limiting embodiments of the store with reference to the accompanying drawings, which respectively illustrate what follows:

FIG. 1A shows a first embodiment and FIG. 1B shows a second embodiment;

FIG. 2A shows the store of FIG. 1A and FIG. 2B shows the store of FIG. 1B;

FIG. 3A shows the store of FIG. 1A and FIG. 3B shows the store of FIG. 1B;

DETAILED DESCRIPTION OF THE PREFERRED EMBODIMENT(S)

Figure 1A:
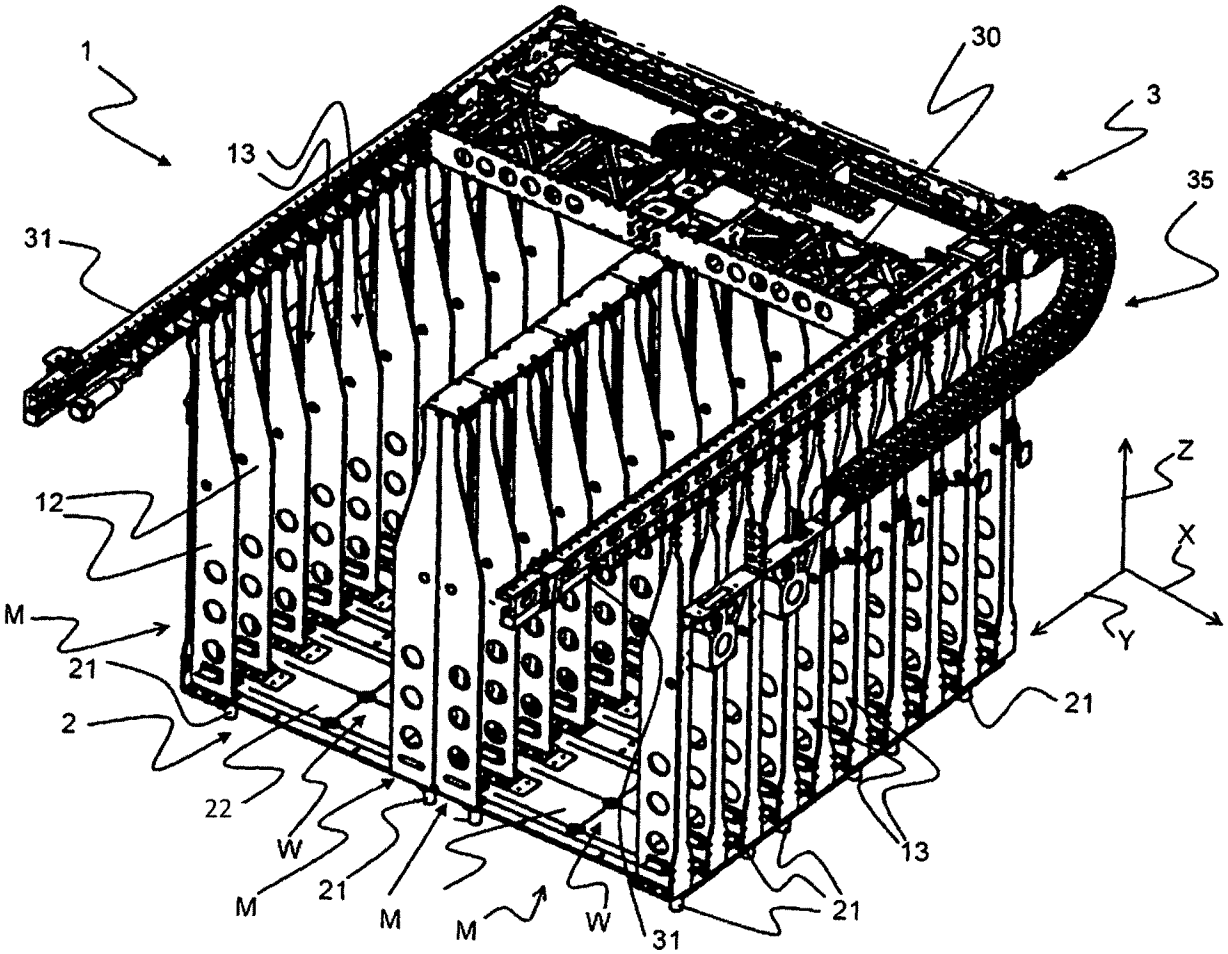
FIGS. 1A and 1B show an axonometric view of the store according to the present invention; in particular.

With reference to the figures mentioned above, modular store 1 is adapted to be preferably installed in the hold of a ship.

The store comprises a plurality of crates "C", which are organized in supplying modules "M", at least one flooring structure 2, which supports said supplying modules "M" and defines a walk-off surface, and a moving system for a handler of said crates.

Said moving system comprises an overhead-travelling-crane 3, which is arranged in the upper part of said supplying modules "M".

Each module "M" defines at least one row, each row having a predetermined number of crates "C". Said modules "M" define a plurality of rows, which are arranged one next to the other, preferably parallel to one another.

Overhead-travelling-crane 3 is adapted to move said handler in a reference plane "XY", so as to reach single crates "C". Said overhead-travelling-crane is moved by means of a moving system 35. Said moving system 35, as shown in the preferred non-limiting embodiment of FIG. 1B, comprises a shaft 351, at whose ends there are fixed two pinions 352, adapted to mesh with a rack comprised in each longitudinal guide 31. Said shaft 351 is controlled by at least one motor 350, which is connected to the shaft by means of at least one mechanism comprising transmissions and reduction gears.

Said overhead-trevelling-crane 3 comprises a horizontal truss 30, which is provided with a carriage 32, to which said handler can be fixed. Said horizontal truss 30 is adapted to slide along longitudinal guides 31.

Said longitudinal guides 31, on which said horizontal truss 30 slides, are rigidly fixed to supplying modules "M". In the preferred non-limiting embodiment, said longitudinal guides 31 are rigidly fixed to two supplying modules "M". Said longitudinal guides, as shown in the appended figures, are arranged so as to be perpendicular, in reference plane "XY", relative to horizontal truss 30.

Said carriage 32 is adapted to slide along said horizontal truss 30.

Said supplying modules "M", on which said longitudinal guides 31 are fixed, are modules "M" of the outer rows of store 1, which define the horizontal extension of the store itself.

For the purpose of the present invention, the term "outer rows" means modules "M" defining the ends of store 1 along the horizontal extension or axis "X" defining the plane.

Each module "M" is rigidly fixed to said flooring structure 2. Each one of said modules "M", as shown in FIGS. 1A, 1B, 2A, 2B, 4, and 6, comprises a plurality of frames 12, adapted to house and support said crates "C".

As shown in FIGS. 1A, 1B, 2A, 2B, 3A, 3B, and 6, wherein said modules "M" are arranged so as to create at least one lane "W", along which said handler can slide.

Furthermore, said modules "M" are arranged so as to create at least one passageway between two parallel lanes "W".

Flooring structure 2 comprises a plurality of coupling means 21.

In the preferred embodiment, said flooring structure 2 is rigidly fixed to the ground by means of said plurality of coupling means 21.

Each one of said coupling means 21 can be adjusted, for example longitudinally, so as to create a walk-off surface—and in particular said flooring structure 2—that is leveled.

In an alternative embodiment, which is not shown, said flooring structure is rigidly fixed to the walls of the hold of a ship by means of said plurality of coupling means 21.

In a further alternative embodiment, which is not shown, said flooring structure is rigidly fixed to the ceiling of the hold of a ship by means of said plurality of coupling means 21.

Preferably, store 1 according to the present invention comprises stabilization elements, which are not shown and are adapted to be fixed to the walls of the place where the store is arranged, for example a hold. Said stabilization elements are adapted to ensure the stability of the store when the latter is subject to direct forces along axes "X" and/or "Y".

Preferably, the store according to the present invention comprise support elements, which are not shown and are adapted to support possible longitudinal guides 31 that project relative to frames 12. Normally, the projection of longitudinal guides 31 is adapted to ensure the passageway for the movements of a handler among the different lanes "W".

In the preferred embodiment, said plurality of coupling means 21 are bolted screws, which fix said flooring structure 2 to the ground or to the structure of the hold of the ship where store 1 is preferably applied.

Preferably, said flooring structure 2 is modular and comprises a plurality of plates 22, which can be rigidly fixed to one another, so as to create a structure that is modular in shape and to optimize the space taken up by store 1.

In the preferred embodiment, each plate 22 comprises first coupling portions 221, where the plates are fixed to one another, so as to obtain the modular flooring structure.

Preferably, plate 22 comprises, furthermore, second coupling portions 222, where modules "M"—and in particular frames 12—are fixed, and third coupling portions 223, where said coupling 21 means are fixed.

This embodiment allows plates 22 to be rigidly fixed to one another, so as to obtain a walk-off surface that has an optimal shape based on the space available.

In the preferred embodiment, said first coupling portion 221 substantially is a portion of a second coupling portion 222; as a matter of fact, it is a frame 12 that, once fixed to two consecutive plates 22, acts as a fixing means between two plates 22.

Figure 2A:
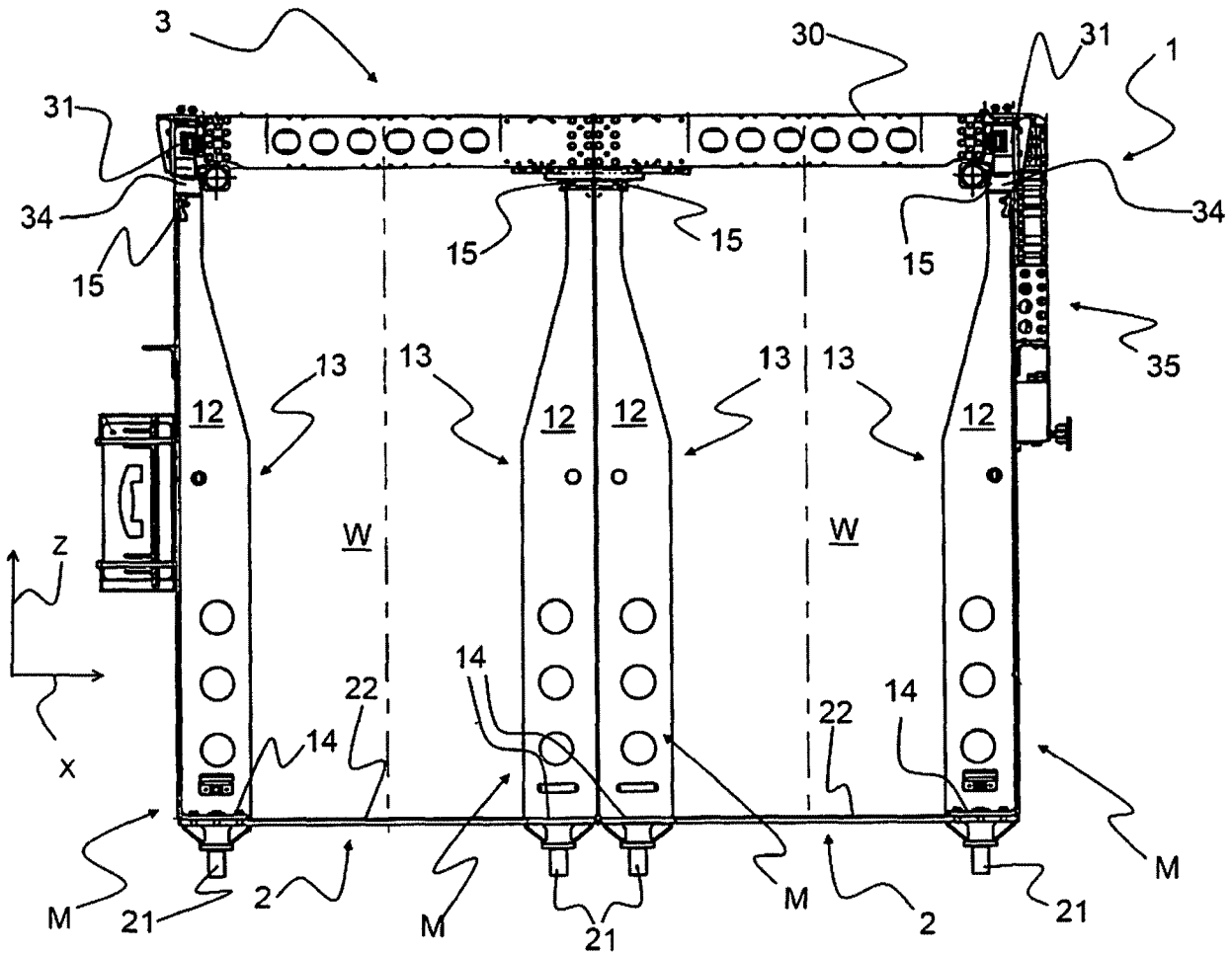
FIGS. 2A and 2B show a front view of the store; in detail.
Figure 3A:
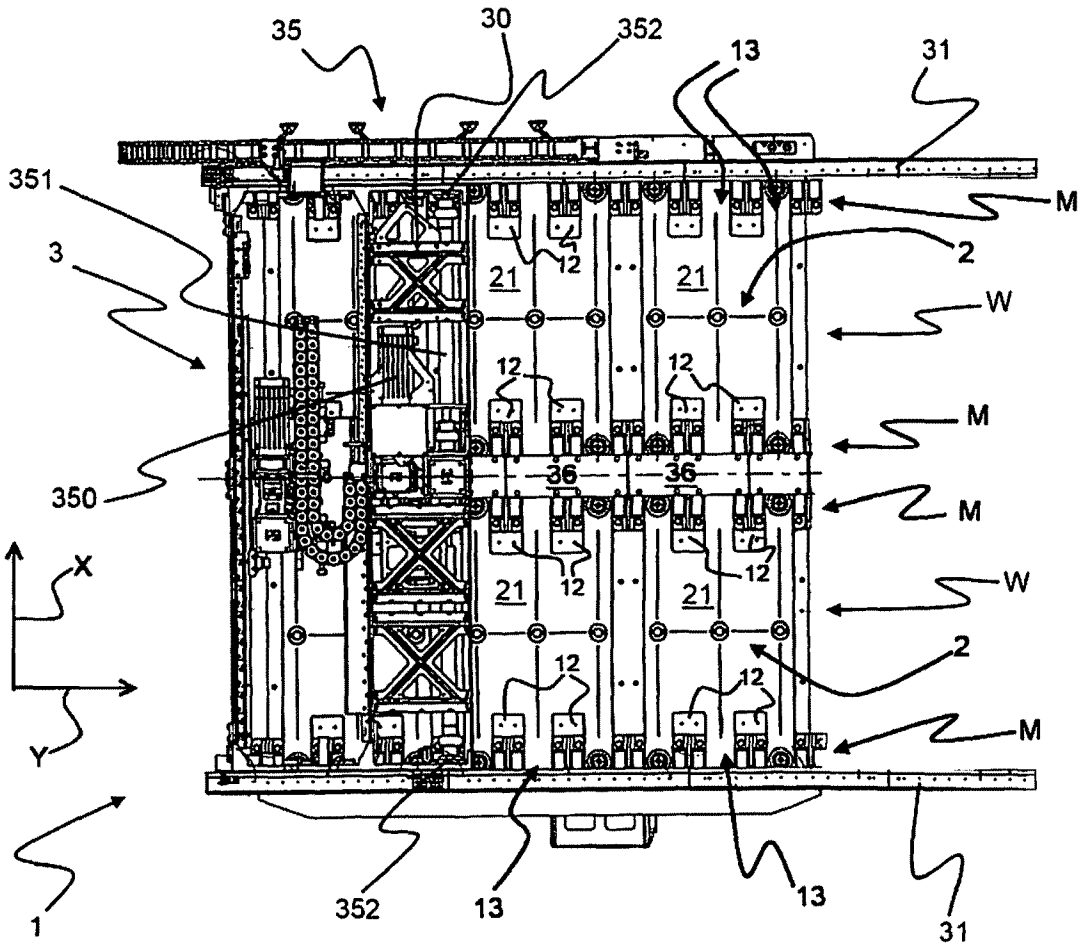
FIGS. 3A and 3B show a plan view from the top of the store according to the present invention; in detail.

In the embodiment shown in FIGS. 1A, 2A, and 3A, there is one single flooring structure 2, which covers the entire area taken up, which is at least equal to the extension of the reference plane "XY" on which overhead-travelling-crane 3 can move.

Figure 1B:
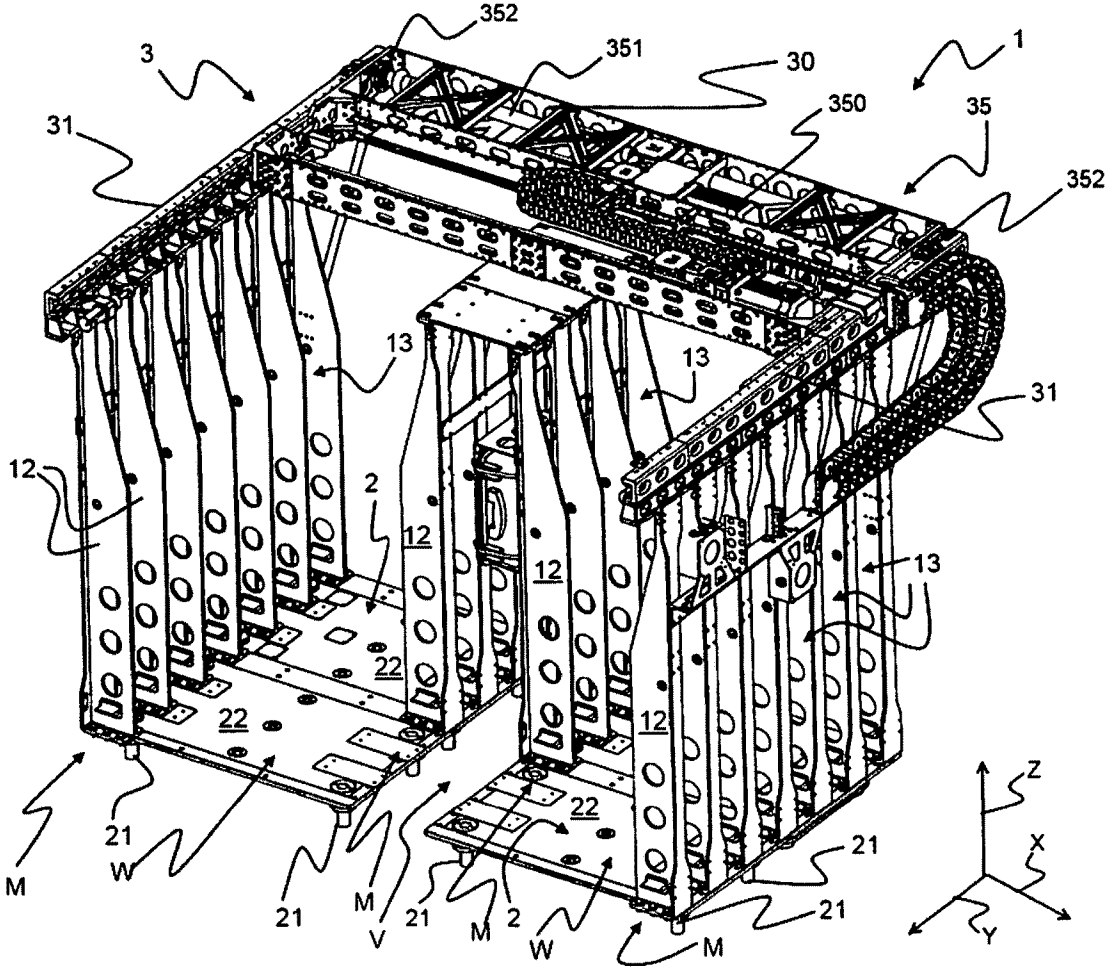
Figure 2B:
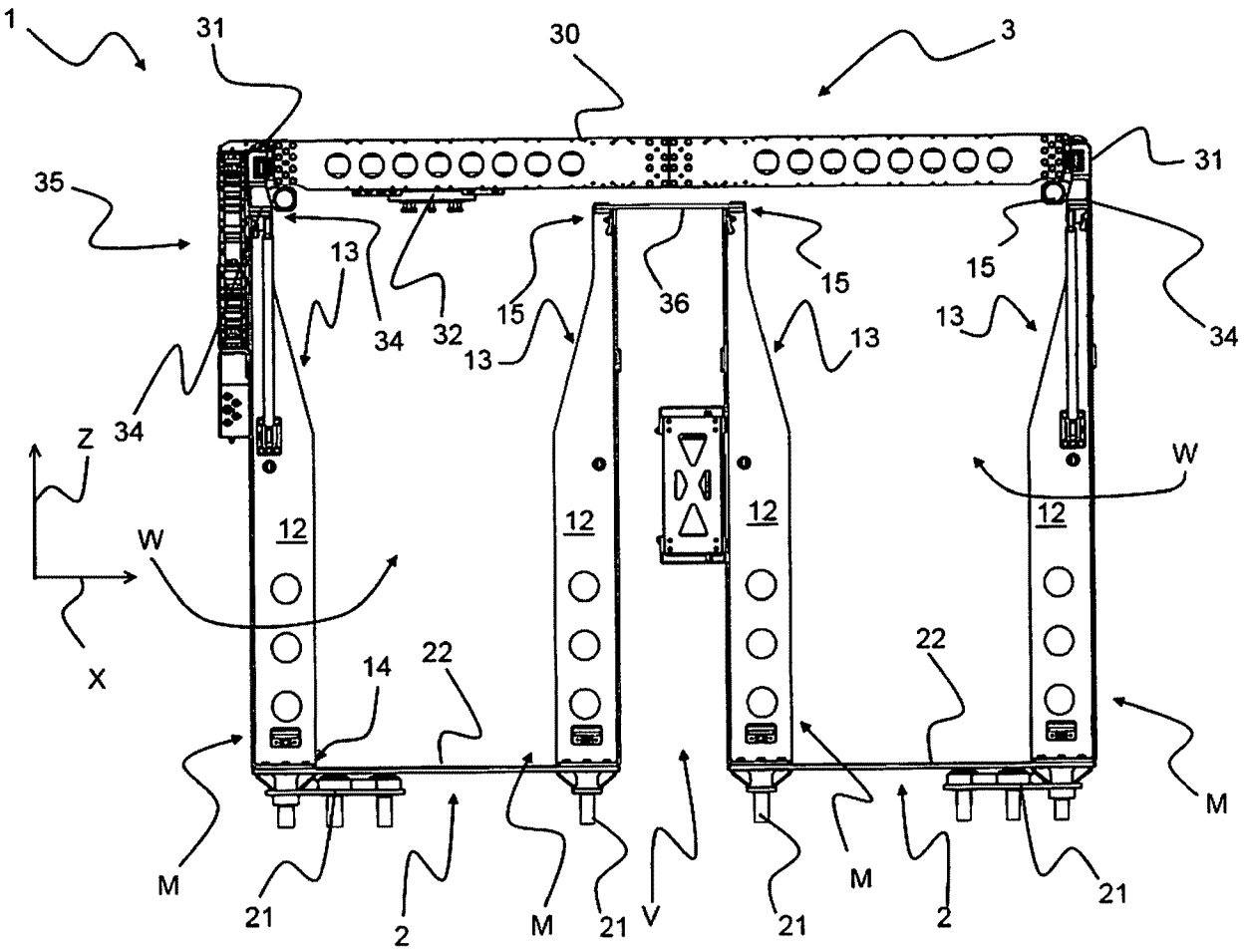
Figure 3B:
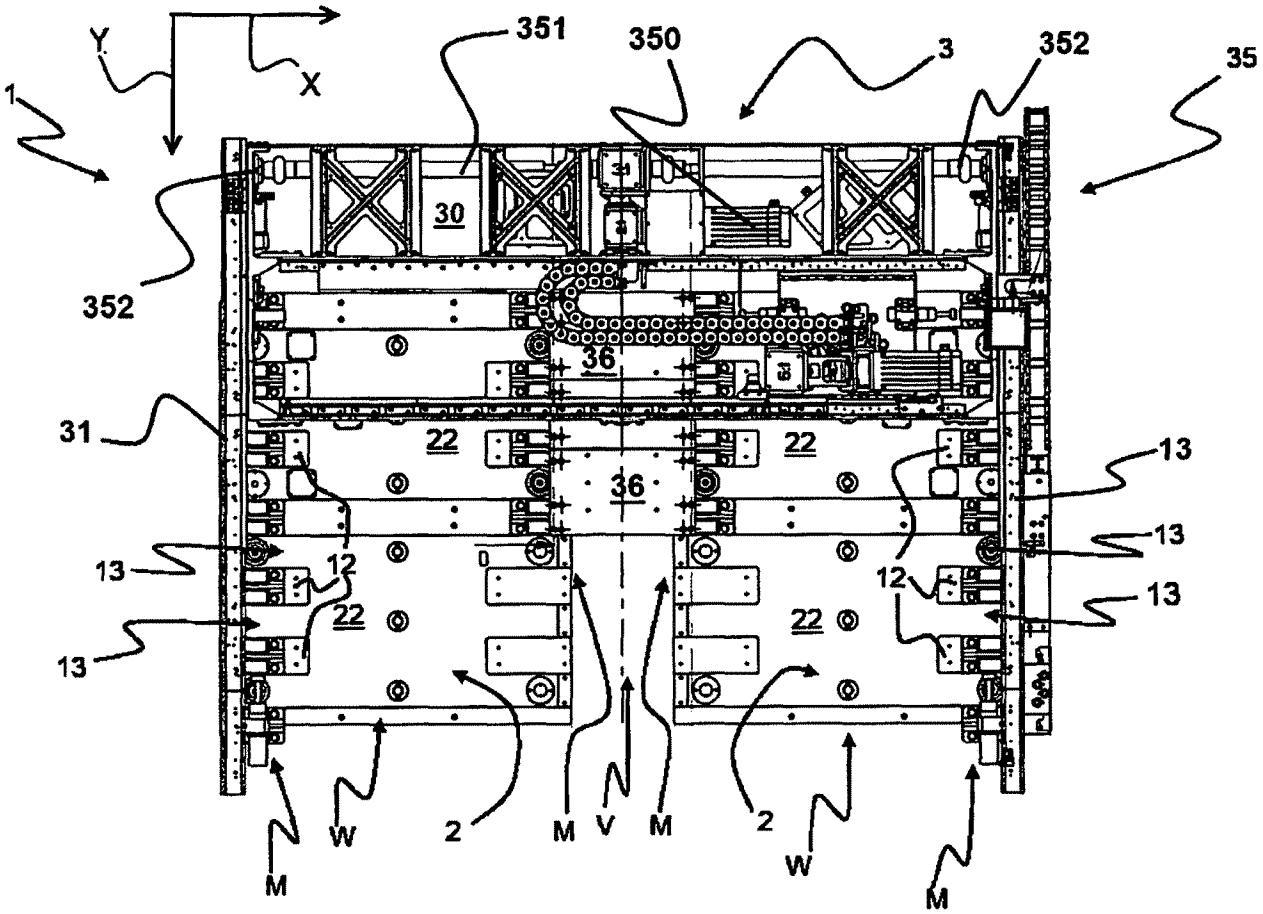
Figure 4:
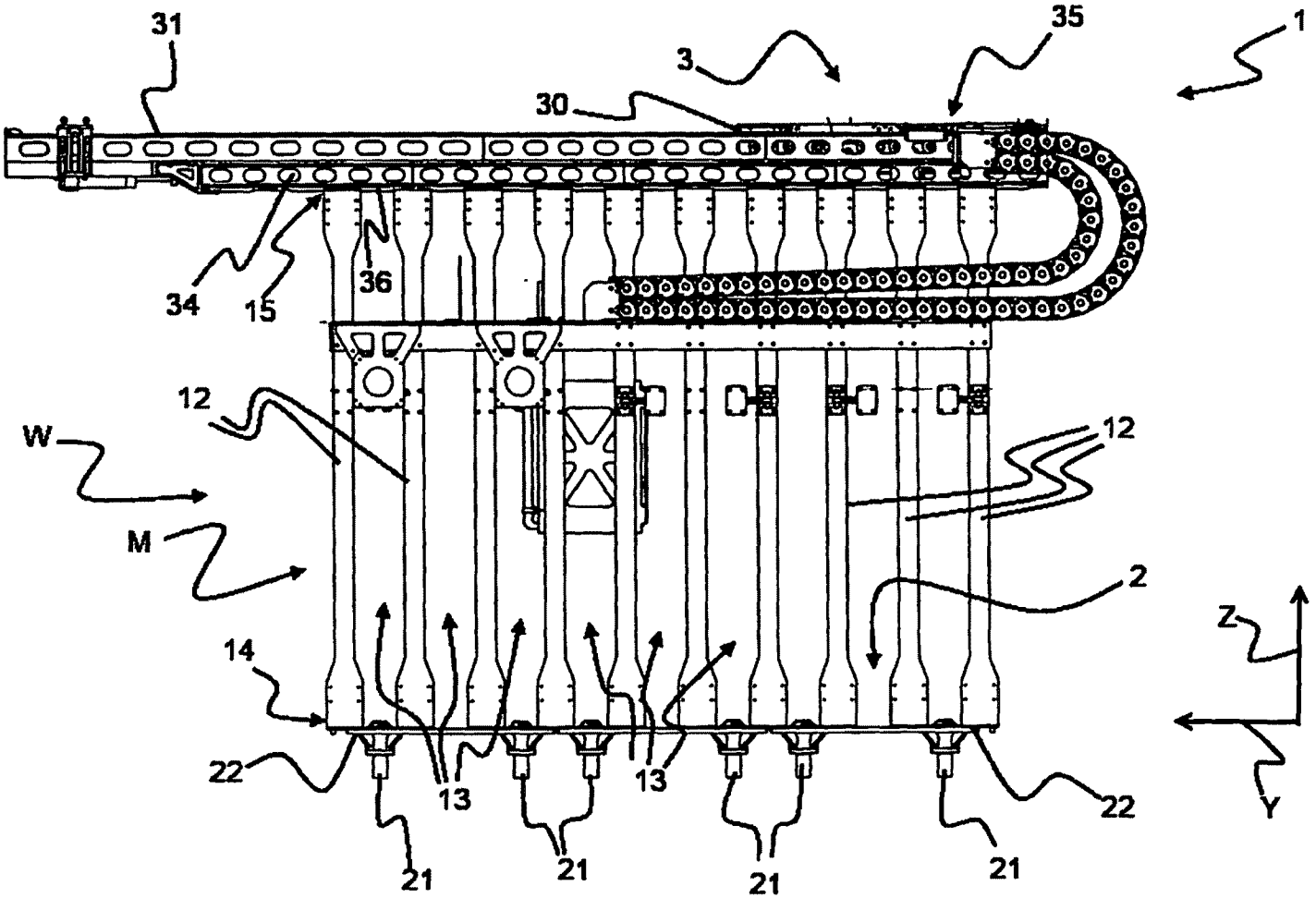
FIG. 4 shows a lateral view of the store according to the present invention.
Figure 5B:
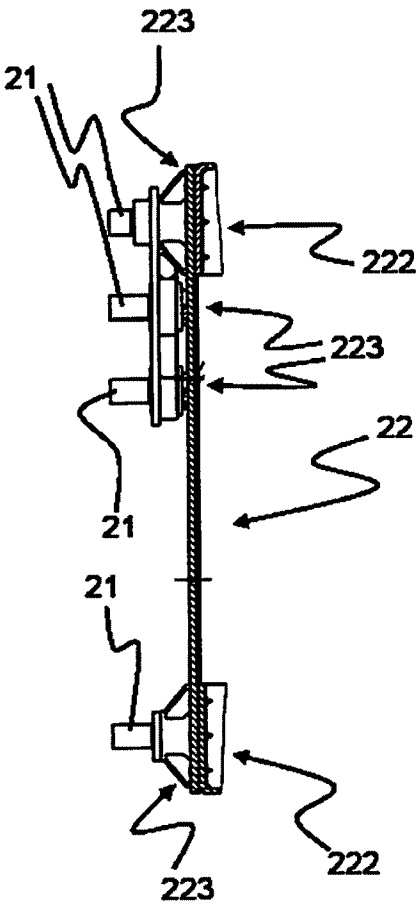
FIGS. 5A and 5B show a details of the flooring structure of the store according to the present invention.
Figure 5A:
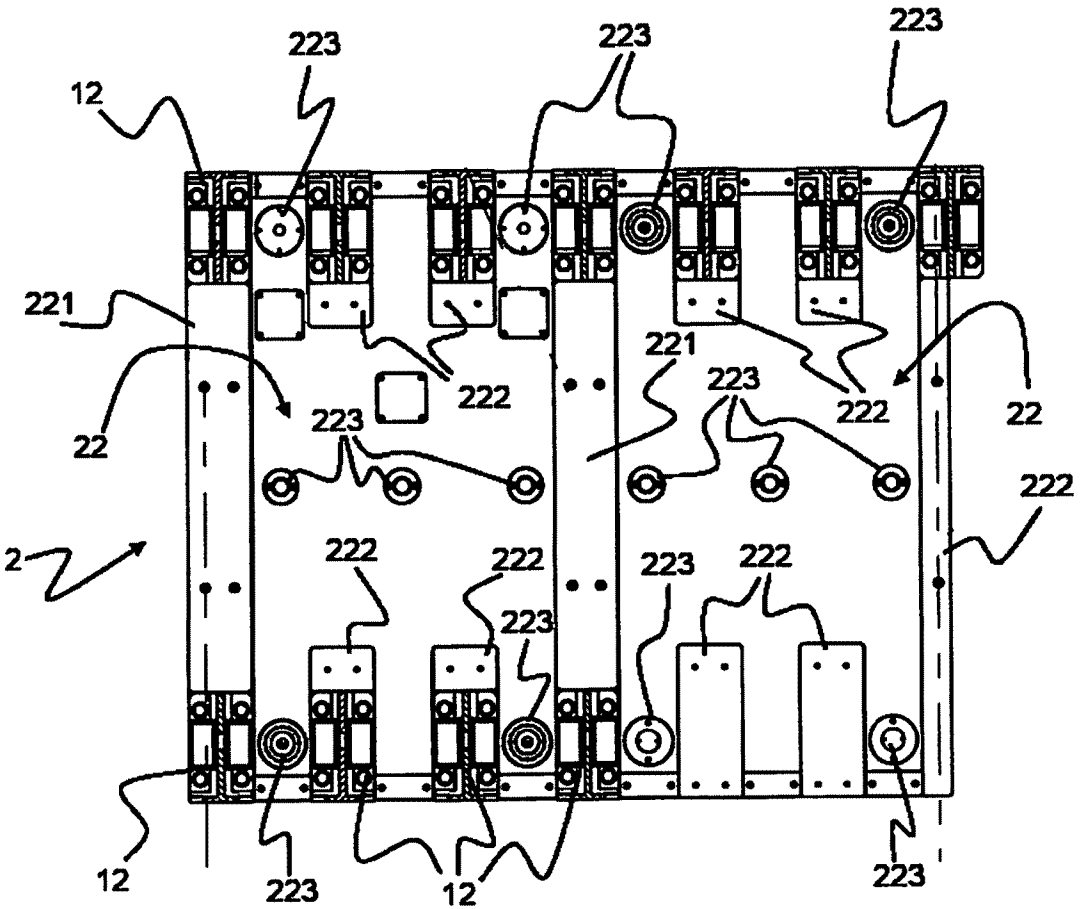
Figure 6:
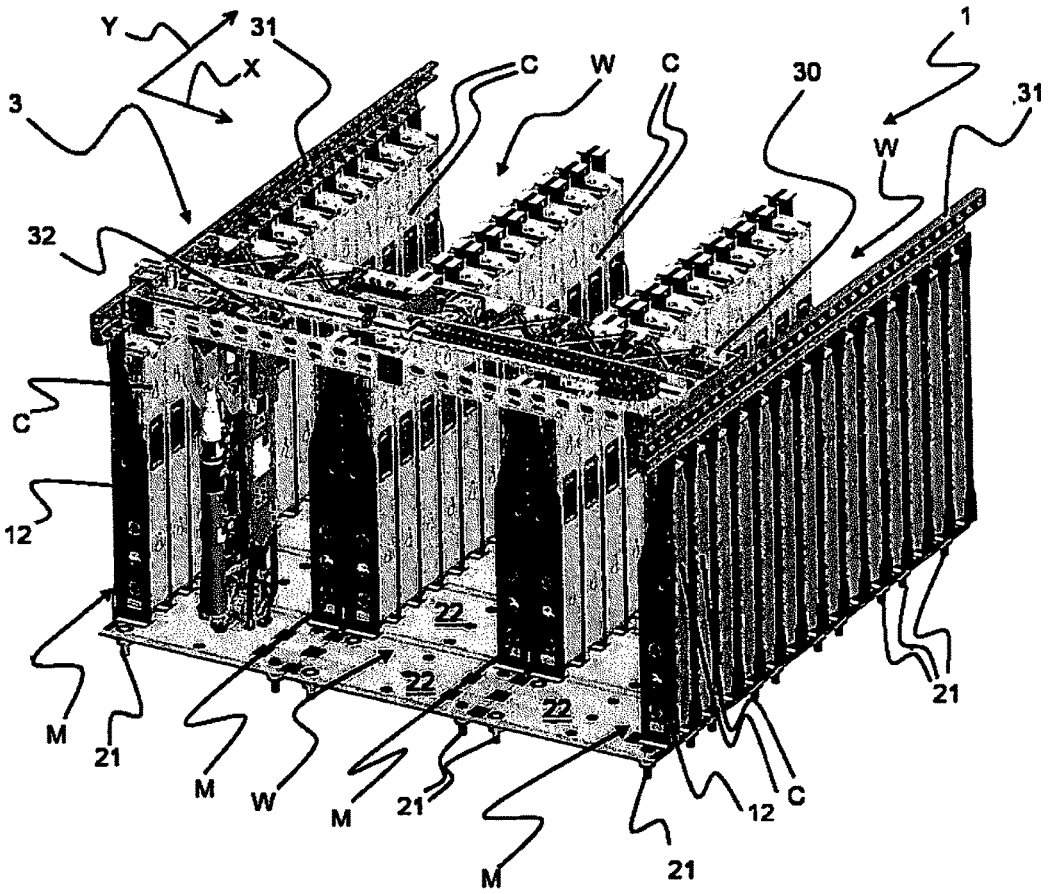
FIG. 6 shows a prospective view of a store comprising a handler.

In the embodiment described in FIGS. 1B, 2B, and 3B, one or more flooring structures 2 can be provided, which, for example, correspond to the number of lanes "W" comprised in store 1. In FIGS. 1B, 2B, and 3B, in particular, two lanes "W" are provided and each of them has its own flooring structure 2.

Said modules "M"—and in particular single frame 12—are rigidly fixed on said flooring structure 2. This configuration helps create a store in which the different parts are correlated with one another, so as to reduce positioning errors.

In the preferred embodiment, two adjacent frames 12 form a housing portion 13, where a crate "C" is arranged. Said frame 12 comprises, furthermore, a lower fixing end 14, adapted to be fixed to a second coupling portion 222 of a plate 22 and an upper fixing portion 15, which can be fixed to support and/or fixing elements (34, 36).

As shown in the appended figures, a first support element 34 is provided, which is arranged in correspondence to modules "M" defining the outer rows and is fixed to frames 12. Said first support element 34, in turn, is fixed to a longitudinal guide 31 of overhead-travelling-crane 3.

Preferably, said support element 34 is a beam with a length that is at least equal to the longitudinal extension of the longitudinal guide 31 fixed thereto.

FIGS. 1B, 2B, and 3B show a fixing element 36, adapted to fix frames 12—and in particular frames 12 not belonging to the same lane "W"—to one another.

In a first embodiment, said fixing element 36 is a flange, adapted to fix two or more frames 12 to one another, the different housing portions 13 facing neighboring adjacent lanes "W".

In a first embodiment, which, for example, is shown in FIGS. 1A, 2A, and 3A, frames 12 facing different lanes "W" are arranged in contact with one another, thus avoiding the creation of hollow spaces.

In a second embodiment, which, for example, is shown in FIGS. 1B, 2B, and 3B, said frames 12 facing different lanes "W" comprise, between one another, a hollow space "V", adapted to permit the passage of operators in charge of the maintenance of store 1 according to the present invention.

Store 1 according to the present invention is adapted to house oblong objects, such as ammunitions. Crates "C" have an oblong shape, as well, so as to be able to house and protect said oblong objects.

Store 1 according to the present invention is assembled in such a way that the elements making up the store itself are modular, this optimizing the space taken up. Furthermore, store 1 is adapted to reduce the positioning errors arising when objects are removed from or positioned into crates "C", since all the elements making up the store are structurally correlated with one another. The store according to the present invention permits to compensate, in an optimal manner, the structural deformations of the store itself due both to the sussultatory movement of the ship and to the deformation of the hold comprised in ship, where in the store is preferably arranged.

NUMERICAL REFERENCES

Store 1
Frames 12
Housing 13
Lower fixing end 14
Upper fixing end 15
Flooring structure 2
Coupling means 21

Plates 22
First fixing portions 221
Second fixing portions 222
Third fixing portions 223
Overhead-travelling-crane 3
Horizontal truss 30
Longitudinal guides 31
Carriage 32
Support element 34
Moving system 35
Motor 350
Shaft 351
Pinions 352
Fixing elements 36
Supplying modules M
Crates C
Lane W
Hollow space V
Reference plane XY

The invention claimed is:

1. A store comprising:

a plurality of supplying modules, which define a plurality of rows, the rows being arranged one next to the other, each row presenting a predetermined number of crates;

at least one flooring structure, comprising a plurality of plates; said at least one flooring structure supporting said supplying modules and defines a walk-off surface;

a moving system for a handler of said crates, the moving system comprising an overhead-travelling-crane, the crane being arranged in an upper part of said supplying modules for moving said handler in a reference plane, so as to reach the crates;

said supplying modules are arranged to create at least one lane; along said at least one lane said handler is adapted to slide to reach the crates;

said overhead-travelling-crane comprises a horizontal truss above said supplying modules, said truss comprises a carriage, said handler being fixed to said carriage;

said horizontal truss is configured for sliding along at least two longitudinal guides, said longitudinal guides being arranged above said supplying modules;

wherein:

said longitudinal guides are rigidly fixed to the supplying modules of external rows, which define horizontal extension of the store;

each supplying module is rigidly fixed to said flooring structure;

each one of said supplying modules comprises a plurality of frames for housing and supporting a crate;

each frame comprises:

a lower fixing end fixed to a second coupling portion of a plate of the flooring structure;

an upper fixing end fixed to at least one fixing element for fixing said frames to one another and/or to the overhead-travelling-crane;

two adjacent frames form a housing portion where a crate is positioned.

2. Store according to claim 1, wherein the flooring structure comprises a plurality of coupling means.

3. Store according to claim 2, wherein said coupling means are adjustable in a longitudinal direction.

4. Store according to claim 2, wherein said plurality of coupling means are bolted screws.

5. Store according to claim 2, wherein the flooring structure is rigidly fixed to the ground by means of said plurality of coupling means.

6. Store according to claim 2, wherein each plate comprises:

first coupling portions configured for fixing the plates to one another, so as to obtain the modular flooring structure;

second coupling portions fixed to the modules; and third coupling portions fixed to said coupling means.

7. Store according to claim 1, wherein said flooring structure is modular, said flooring structure comprising a plurality of plates configured to be rigidly fixed to one another.

8. Store according to claim 7, wherein each plate comprises:

first coupling portions configured for fixing the plates to one another, so as to obtain the modular flooring structure;

second coupling portions fixed to the supplying modules;

third coupling portions fixed to coupling means of the flooring structure.

9. A store comprising:

a plurality of supplying modules, which define a plurality of rows, the rows being arranged one next to the other, each row presenting a predetermined number of crates;

at least one flooring structure, comprising a plurality of plates; said at least one flooring structure supporting said supplying modules and defines a walk-off surface;

a moving system for a handler of said crates, the moving system comprising an overhead-travelling-crane, the crane being arranged in an upper part of said supplying modules for moving said handler in a reference plane to reach the crates;

said supplying modules are arranged to create at least one lane; along said at least one lane said handler is adapted to slide to reach the crates;

said overhead-travelling-crane comprises a horizontal truss above said supplying modules; said truss comprises a carriage, said handler being fixed to the carriage;

said horizontal truss is configured for sliding along at least two longitudinal guides; said longitudinal guides being arranged above said supplying modules;

wherein:

said longitudinal guides are rigidly fixed to the supplying modules of external rows, which define horizontal extension of the store;

each supplying module is rigidly fixed to said flooring structure;

each one of said supplying modules comprises a plurality of frames, for housing and supporting a crate;

each frame comprises:

a lower fixing end fixed to a second coupling portion of a plate of the flooring structure;

an upper fixing end, said upper fixing end being fixed to at least one fixing element for fixing said frames to one another and/or to the overhead-travelling-crane;

two adjacent frames form a housing portion, where a crate is positioned;

said plurality of plates are configured to be rigidly fixed to one another; each of said plates comprises a plurality of couplings; said couplings comprise bolted screws adjustable in a longitudinal direction, wherein said flooring structure defines an homogeneous and flat flooring structure;

the flooring structure is rigidly fixed to the ground by said plurality of couplings.

* * * * *